United States Patent [19]

Eichelberger

[11] 4,250,504

[45] Feb. 10, 1981

[54] GAS DISCHARGE DISPLAY CIRCUIT

[75] Inventor: Charles W. Eichelberger, Schenectady, N.Y.

[73] Assignee: General Electric Company, Schenectady, N.Y.

[21] Appl. No.: 68,752

[22] Filed: Aug. 23, 1979

[51] Int. Cl.[3] ..... G08B 5/36

[52] U.S. Cl. ..... 340/758; 315/169.1; 340/813

[58] Field of Search ..... 340/758, 813; 315/311, 315/169.1

[56] References Cited

U.S. PATENT DOCUMENTS

| | | | |
|---|---|---|---|
| 3,594,758 | 7/1971 | Gluck | 340/813 |
| 3,794,881 | 2/1974 | Janssen | 340/758 X |
| 3,821,598 | 6/1974 | Holz | 340/758 X |
| 4,109,180 | 8/1978 | Ogle et al. | 340/813 X |

*Primary Examiner*—David L. Trafton

*Attorney, Agent, or Firm*—Geoffrey H. Krauss; Marvin Snyder; James C. Davis

[57] ABSTRACT

A gas discharge display circuit for driving a plurality of gas discharge tubes in a time-multiplexed manner is disclosed. Each of the tubes include an anode, a plurality of display cathodes and a control cathode. A tube selection circuit generates a plurality of tube drive pulses which are sequentially applied to the anodes of each of the gas discharge tubes. A display cathode selection circuit, including a plurality of low-breakdown-voltage saturated switches, is coupled in parallel to each display tube and determines which display elements of each display tube are to be lighted in response to the application of the tube drive pulse. After a given display tube has been fired, a current control regulation circuit adjusts the anode voltage to the particular level required to induce a predetermined current in the lighted display cathodes. The current control regulation circuit utilizes the current in the control cathode of the fired display tube to regulate the anode voltage of the fired tube and thereby ensure a predetermined current in each of the display cathodes.

31 Claims, 5 Drawing Figures

SHIFT REGISTER
CLOCK IN
DATA IN
VCC
VSS
D3
D2
D1
D0
36
+180
R3
+175
R4
R2
R1
C1
C2
CLOCK
ENABLE
CONTROL CIRCUIT
34
10
DATA 0
DATA 1
DATA 2
DATA 3
DATA 4
DATA 5
DATA 6
Q1
Q2
Q3
Q4
Q5
Q6
Q7
ANODE 0
ANODE 1
ANODE 2
ANODE 3
14
+90
R7
VB
R6
18
VA
R5
+5
R8
CLOCK
12
28
30
32
26
24
22
20
CATH 0
CATH 1
CATH 6
SW0
SW1
SW6
DATA 0
DATA 1
DATA 6
16

10'
CONTROL CIRCUIT
34
CLOCK
ENABLE
C1
C2
R1
R2
+180
SHIFT REGISTER
36
CLOCK IN
DATA IN
Vcc
Vss
D0
D1
D2
D3
Q1
Q2
Q3
Q4
+175
R3
R4
R7
R6
R5
VB
VA
Q5
Q6
+90
14
12
18
16
ANODE 0
ANODE 1
ANODE 2
ANODE 3
D1
D2
D3
D4
R10
R11
R12
CATH 0
CATH 1
CATH 6
SW0
SW1
SW6
DATA 0
DATA 1
DATA 6
20
22
24
26
28
30
38
40

GAS DISCHARGE DISPLAY CIRCUIT

BACKGROUND OF THE INVENTION

The present invention relates to gas discharge display tubes and more particularly to gas discharge display tubes of the type which include a plurality of display cathodes which may be selectively enabled to form a plurality of display patterns.

Gas discharge display tubes of the foregoing type include an anode and a plurality of display cathodes spaced therefrom. The display cathodes are separated from the anode by an insulating gas which permits current flow between the anode and cathode only when the potential difference therebetween exceeds the breakdown voltage of the gas. When this potential difference (the turn-on voltage of the tube) is exceeded, current will flow through the display cathodes and they will light. By adjusting a potential difference between each cathode and the anode independently, it is possible to illuminate only selected cathodes so as to display a desired pattern. The luminosity of each of the enabled cathodes is determined by the magnitude of the current flowing through the cathode. By adjusting current flow through each illuminated cathode, the luminosity of that cathode may also be controlled.

In prior art gas discharge display tubes, the foregoing results are obtained by placing a predetermined voltage on the anode of the discharge tube and adjusting the voltage at the display cathodes to selectively turn on desired cathodes. Those cathodes which are to remain off are biased at a potential near the anode potential while those cathodes which are to be turned on are switched to a voltage at least the turn-on voltage below the anode voltage. Once the given cathode is turned on, a current limiter circuit associated with the respective cathode controls the cathode current to ensure the desired luminosity.

While the foregoing arrangement is generally satisfactory, it cannot economically be used in connection with low cost bipolar or MOS integrated circuitry. Since such circuitry is capable of outputting relatively low voltage swings (typically below 30 volts), their output cannot be directly used to drive the cathodes of the display tubes. Additionally, the relatively low cost of the bipolar or MOS control circuitry used to turn selected cathodes on is offset by the fact that individual current control elements must be utilized in connection with each individual cathode. As a result of the foregoing drawbacks, the use of gas discharge display tubes has generally been rejected in connection with low cost bipolar or MOS circuit arrangements despite the generally advantageous characteristics of gas discharge tubes: relatively low power for large digit size, the lowest cost for custom patterns and patterns where both size and number of digits is relatively large.

BRIEF DESCRIPTION OF THE INVENTION

The present invention overcomes the foregoing drawbacks by utilizing low-breakdown-voltage saturated switches to adjust the potential of each of the display cathodes and thereby enable selected cathodes to display a desired alpha-numeric character. Such switches may be turned on and off utilizing a very small voltage swing applied to their control input (e.g., 1–2 volts) and may be formed utilizing low cost bipolar or MOS integrated circuit processes. As such, these switches may directly control the operation of the display tube as a function of low magnitude control signals produced by low cost bipolar or MOS integrated control circuits. Additionally, these switches may be prefabricated along with the control circuit in a single chip.

In addition to the foregoing, the present invention utilizes a control cathode which senses a current representative of the current flowing through the lighted display cathodes and utilizes the current to adjust the anode voltage of the tube and therefore the current through the lighted display cathodes. In this manner, the current through each of the display cathodes, and therefore the luminosity of these cathodes, may be controlled without requiring current limiting circuitry associated with each individual display cathode.

Since a special control cathode is not provided in most commercially available gas discharge display tubes, the first embodiment of the invention utilizes an unused display cathode of a conventional discharge tube for this purpose. In order to ensure that the control cathode is not seen by the user of the device, an opaque mask is applied to the glass enclosure of the tube over the area where the control cathode is located.

In addition to the anode and display cathodes noted above, most conventional gas discharge tubes include keep-alive elements including a keep-alive cathode and a keep-alive anode. These elements are energized at all times to provide a source of ions and ionization photons in order that rapid firing occurs during each multiplex time period. In a second embodiment of the present invention, the keep-alive cathode is utilized as the control cathode and the keep-alive anode is coupled to the display anode by an appropriately polarized diode in order that the voltage at the keep-alive anode follows that of the keep-alive cathode after the application of a tube firing pulse to ensure that the current in the keep-alive cathode is proportional to that in the display cathodes.

In many applications involving the use of gas discharge display tubes, it is also necessary to light a few neon bulbs which are used as indicator lamps. In order to accommodate these requirements, a third embodiment of the invention utilizes an X-Y matrix whose inputs are the tube firing pulses applied to the anodes of the gas discharge tubes and the outputs of additional low breakdown voltage saturated switches, respectively. The tube firing pulses are applied to the anodes of a first set of pairs of neon indicators while the outputs of the additional saturated switches are applied to a second set of pairs of the cathodes of the neon indicators. Current limiting switches are provided between each of the additional saturated switches and the anodes of the neon indicators to control the current flow through the neon indicators.

BRIEF DESCRIPTION OF THE DRAWINGS

For the purpose of illustrating the invention, there are shown in the drawings several embodiments which are presently preferred; it being understood, however, that this invention is not limited to the precise arrangements and instrumentalities shown.

DETAILED DESCRIPTION OF THE PREFERRED EMBODIMENT

Figure 1:
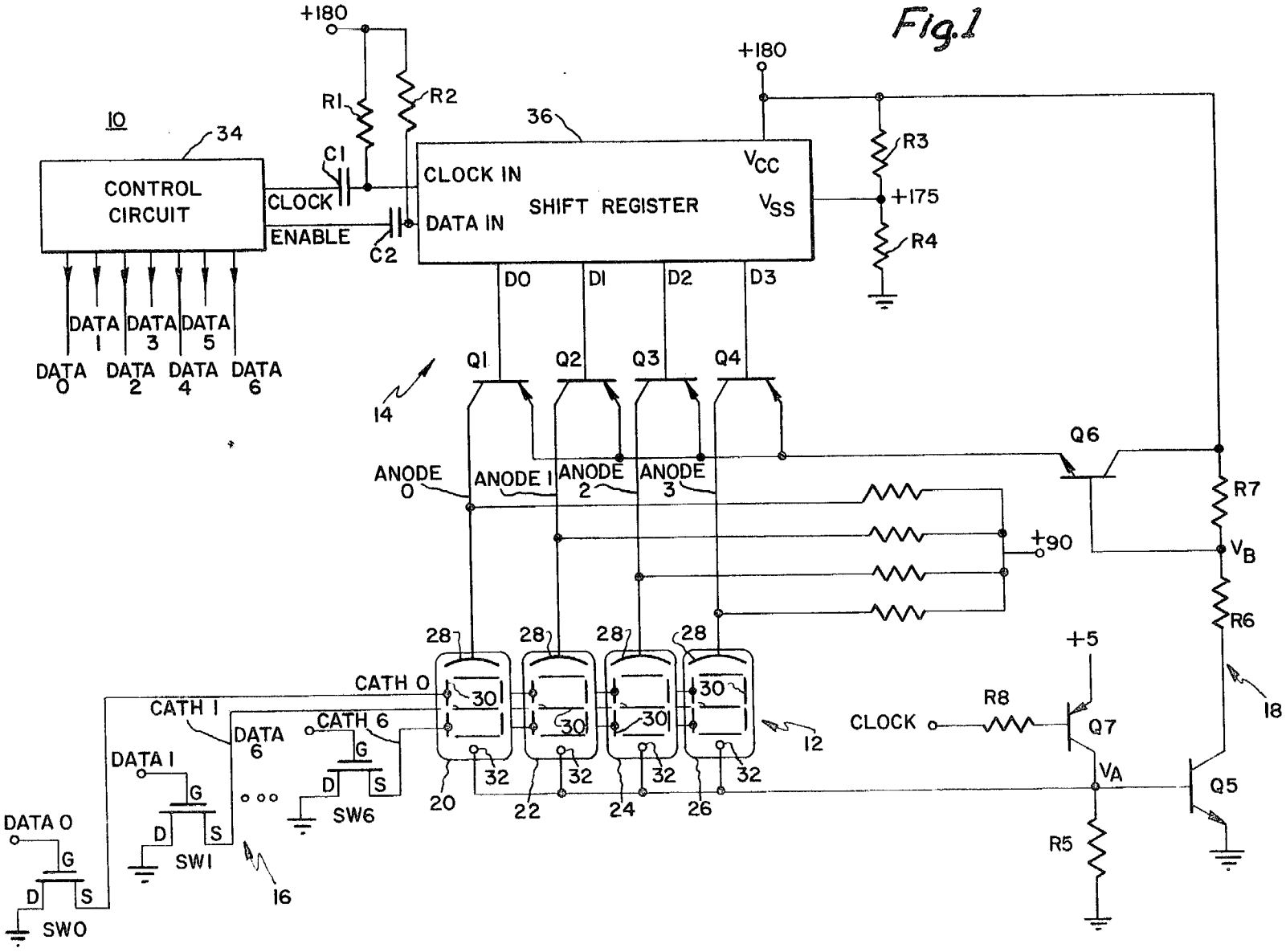
FIG. 1 is a circuit diagram illustrating a first embodiment of a gas discharge display circuit constructed in accordance with the present invention.
Figure 2:
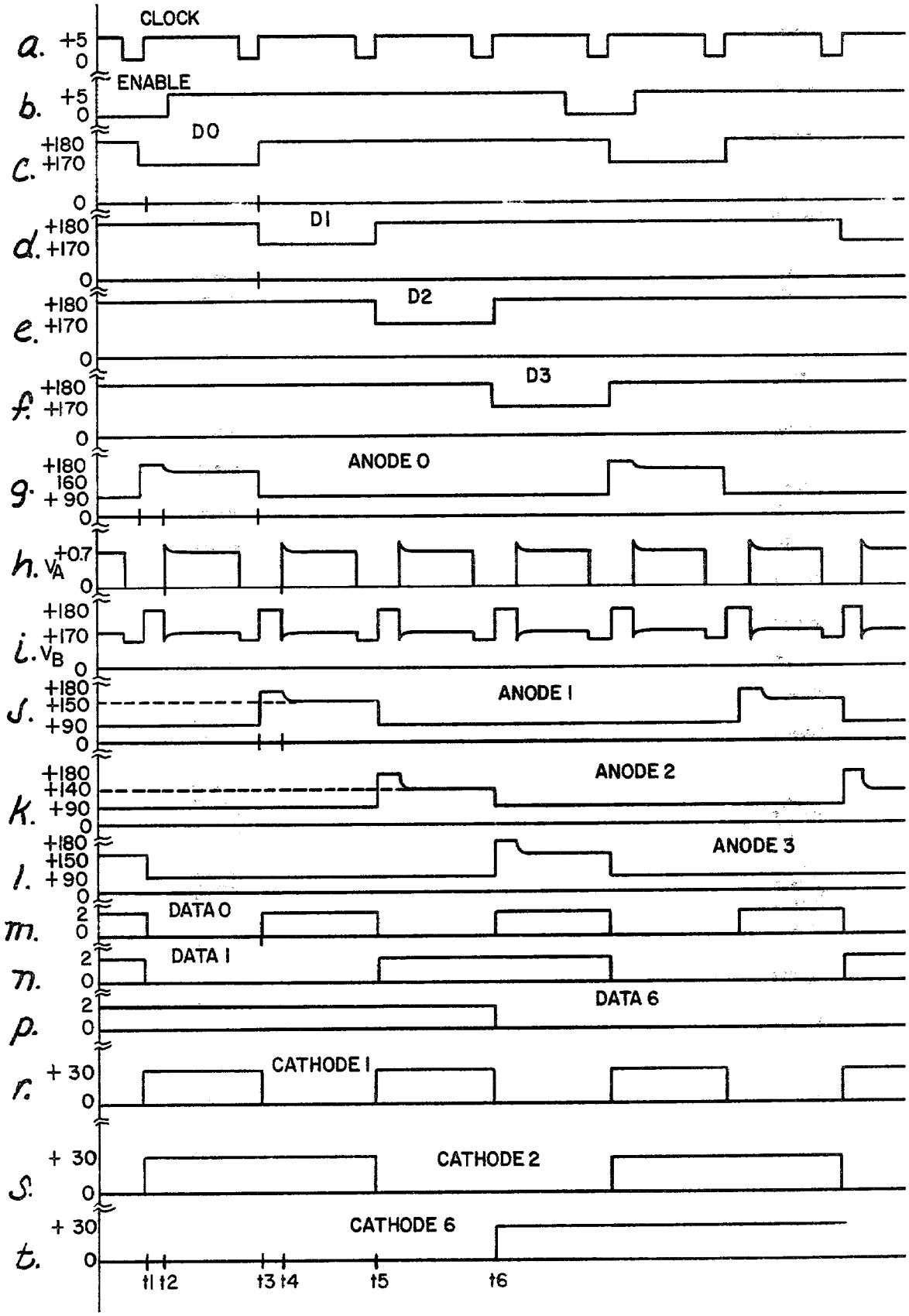
FIG. 2 is a timing diagram of the circuit of FIG. 1.

Referring now to the drawings, wherein like numerals indicate like elements, there is shown in FIG. 1 a circuit diagram of a gas discharge display circuit constructed in accordance with the principles of the present invention and designated generally as 10. Gas discharge display circuit 10 includes a display tube section 12, a tube selection section 14, a display cathode selection section 16 and a current control regulation or feedback section 18.

Display tube section 12 includes a plurality of gas discharge display tubes 20, 22, 24 and 26, each of which includes an anode 28, a plurality of display cathodes 30 and a control cathode 32. In the embodiment illustrated, each display cathode 30 defines one segment of a standard seven segment alpha-numeric display. Any other type of display may, however, be utilized.

In order to minimize cost and power dissipation, it is preferable to scan display tubes 20–26 in accordance with standard multiplexing techniques. Particularly, it is desirable to turn each tube 20–26 on sequentially such that only one tube is on at any given instant. To this end, tube selection section 14 sequentially applies tube firing pulses ANODE 0, ANODE 1, ANODE 2 and ANODE 3 to the anodes 28 of each of the tubes 20–26, respectively, in a time multiplexed manner. See FIGS. 2G and 2J–2L.

Tube selection section 14 includes a control circuit which generates the CLOCK and ENABLE outputs illustrated in FIGS. 2A and 2B, respectively. The CLOCK pulses generated by control circuit 34 are applied to the CLOCK input of shift register 36 via a capacitor C1. The clock input of shift register 36 is normally biased to a positive potential (a binary "1") by the positive biasing voltage (180 volts) applied to the resistor R1. As such, shift register 36 will clock in the information contained on its data input each time a new CLOCK pulse is generated by control circuit 34. As will become apparent below, the frequency of the CLOCK pulses determines the frequency at which each tube 20–26 is fired. While any desired scanning rate may be used, it is preferred that the frequency of the CLOCK pulses be sufficient to cause each of the tubes 20–26 to be fired at at least a 60 Hz rate to avoid "flicker" in the tubes 20–26.

The ENABLE pulses generated by control circuit 34 are applied to the data input of shift register 36 via capacitor C2. The data input of shift register 36 is normally biased to a positive potential (a binary "1") by the 180 volts applied across resistor R2. As shown in FIGS. 2A and 2B, the width of each ENABLE pulse is somewhat longer than the width of each CLOCK pulse to insure that shift register 36 reads a binary "0" at its data input each time an ENABLE pulse is generated. As a result of the foregoing, a binary "0" is shifted through the outputs D0–D3 of shift register 36 at the clock frequency. See FIGS. 2B–2E. As a result of the biasing potentials Vcc and Vss in the embodiment illustrated, a binary "1" at the output of shift register 36 is represented by 180 volts while a binary "0" at its output is represented by 175 volts. These voltages are shown merely by way of example and any other appropriate voltage could be utilized if suitable changes are made with respect to the remaining biasing voltages illustrated.

As shown in FIGS. 2A and 2B, one ENABLE pulse is generated for each set of four CLOCK pulses, since there are four display tubes 20–26 in the example shown. Generally speaking, the ratio of clock to data pulses will be equal to the number of display tubes in display tube section 12 in order that only one output of shift register 36 will be at the binary "0" level at any given time.

The outputs D0–D3 of shift register 36 are applied to the base inputs of transistors Q1–Q4, respectively. At the initiation of any tube firing sequence, a biasing voltage of 180 volts is applied to the emitters of transistors Q1–Q4 by transistor Q5 which is coupled in an emitter follower configuration. As such, each transistor Q1–Q4 whose base is coupled to an output D0–D3 which is at a binary "1" level (i.e., 180 volts) will be biased off while that one of transistors Q1–Q4 whose base is coupled to the output D0–D3 which is at a binary "0" level (i.e., 175 volts) will be turned on. This operation may best be understood with reference to FIG. 2. At time t1, output D0 is at the binary "0" level and outputs D1–D3 are at the binary "1" level. See FIGS. 2C–2F. Since the emitters of transistors Q1–Q4 are at 180 volts, transistor Q1 will be on and transistors Q2–Q4 will be off. In this condition, the anodes 28 of tubes 22–26 will be biased at a quiescent voltage level lying midway between the turn-on voltage of the tube (that voltage required to cause current to flow between anode 28 and cathodes 30) and ground by an appropriate biasing voltage (90 volts in the example shown) applied to resistor R1. See FIGS. 2J–2L. Since this voltage is below the turn-on voltage of the tube, tubes 22–26 will be off.

At this time, transistor Q1 is on and the 180 volt potential appearing at the emitter of transistor Q5 is applied to the anode 28 of tube 20. See FIG. 2G. This voltage, designated ANODE 0, represents a tube firing voltage which causes tube 20 to fire and thereby causes current to flow through the grounded cathodes 30 of tube 20. Shortly after tube 20 fires, the magnitude of the voltage applied to its anode 28 is reduced to a lower value which causes the current in the grounded cathodes 30 to reach a predetermined value. The manner in which this adjustment occurs will be described with reference to current control feedback section 18, below. At time t2, when the next CLOCK pulse is applied to the clock input of shift register 36, the D0 output of shift register 36 returns to the binary "1" level and the D1 output shifts to the binary "0" level. Transistor Q1, and therefore tube 20, turns off while transistor Q2, and therefore tube 22, turns on. See FIGS. 2G and 2J. This sequence is repeated at the CLOCK frequency as the binary "0" output is shifted through the outputs D0–D3 of shift register 36.

While tube selection circuit 14 determines which tube 20–26 is on at any given instant, the display pattern displayed by the turned-on tube is controlled by display cathode selection section 16. Selection section 16 includes a plurality of low breakdown voltage saturated switches SW0, SW1, . . . , SW6 (hereinafter generally switches SW) which preferably have breakdown voltages of less than 30 volts. Such switches may be formed utilizing low cost integrated circuit processes and may therefore be integrated along with the control circuit 34. These switches may be turned on with a relatively low voltage swing on their control input of 1 to 2 volts. As such, the control inputs of these switches may be directly coupled to the outputs of a low cost integrated control circuit 34 which typically generates output signals of such magnitude.

In the embodiment illustrated, each switch SW is a MOSFET whose drain D is grounded, whose source S is coupled to a respective one of the display cathodes 30 of each tube 20–26 and whose gate G is coupled to a respective data output DATA 0, DATA 1, . . . , DATA 6 (hereinafter generally DATA outputs) of control circuit 34. Each switch SW is coupled to the same display cathode 30 of each tube 20–26; for example, switch SW0 is coupled to the upper left-hand display cathode 30 of each tube 20–26.

The condition of each of the saturated switches SW is determined by the DATA outputs of control circuit 34. Those switches SW whose DATA input is at a binary "1" level (e.g., 2 volts) will be turned on and their associated cathodes 30 will be grounded. Those switches whose DATA input is at the binary "0" level (e.g., 0 volts), will be turned off. In this condition, their source terminal s will float at the highest biasing voltage of control circuit 34 (e.g., 30 volts) and the potential difference between the floating cathodes 30 and the anode 28 of the turned-on tube 20, 22, 24 or 26 will be insufficient to cause current to flow therebetween.

The manner in which cathode selection section 16 controls the operation of switches 20–26 may best be understood with reference to FIGS. 2M–2T. During the time interval t1–t3, transistor Q1 is turned on and tube 20 is enabled. During this interval, data inputs DATA 0 and DATA 1 are at the binary "0" level and data input DATA 6 is at the binary "1" level. In this condition, those cathodes 30 connected to the source S of switches SW0, SW1 will be floating at the 30 volt level and no current will flow through these cathodes. On the other hand, the source S of switch SW6 will be grounded and current will flow through its associated cathode 30. At time t3, tube 20 is turned off and tube 22 is turned on. See FIGS. 2G and 2J. Since tube 22 is to display a different pattern than tube 20, the DATA outputs of control circuit 34 also change. In the example illustrated in FIGS. 2M–2T, data outputs DATA 0 and DATA 6 are at the binary "1" level while DATA 1 is at the binary "0" level during time interval t3–t5. In this condition, the cathode 30 coupled to switch SW1 jumps to the +30 volt level while the cathodes 30 coupled to the source S of switches SW0 and SW6 are grounded. As such, current flows through those cathodes 28 of tube 22 which are associated with switches SW0 and SW6. As shown in FIGS. 2M–2T, the state of the DATA outputs of control circuit 34 changes at a frequency equal to the clock frequency so as to produce the desired display in each tube 20–26 as these tubes are sequentially enabled by the tube firing pulses ANODE 0–ANODE 3.

After a given tube 20–26 has been turned on by tube selection section 14 and a given display pattern has been determined by display cathode selection section 16, it is necessary to adjust the current flowing through the grounded cathodes 30 to ensure that each of the grounded cathodes will exhibit a predetermined luminosity. This function is provided by current control feedback section 18.

When a given tube 20–26 fires, current flows between its anode 28 and those ones of its display cathodes 30 which have been grounded by display cathode selection circuit 16. Current also flows through its respective control cathode 32. This current is representative, to a first order, of the current flowing through grounded control cathodes 30 and is used by feedback section 18 to adjust the voltage at anode 28 and therefore the current through grounded display cathodes 30.

The operation of feedback section 18 may best be understood with reference to FIGS. 2G–2L. As shown in FIG. 2G, the ANODE 0 tube firing pulse is applied to the anode 28 of tube 20 at time t1. Just prior to this instant, no current flows through any of the control cathodes 32 and the voltage $V_A$ at the base of transistor Q5 is at 0 volts DC. See FIG. 2H. So biased, transistor Q5 is off and the base voltage $V_B$ of transistor Q6 is at the 180 volt potential applied across voltage divider R3–R4. This base voltage is applied to the emitters of transistors Q1–Q4 in the manner described above causing the 180 volt potential to be applied to the anode 28 of tube 20. After a short time delay (at time t2), tube 20 fires and current flows between its anode 28 and its control cathode 32. This current is applied to resistor R5 and causes an increase in the base voltage $V_A$ at the base of transistor Q5. See FIG. 2H. When the voltage $V_A$ across resistor R5 rises above the base-emitter voltage of transistor Q5, transistor Q5 begins to turn on, causing current to flow through resistors R6 and R7. Resistors R6 and R7 act as a voltage divider which reduces the voltage $V_B$ appearing at the base of transistor Q6. The reduction in base voltage of transistor Q6 causes a similar reduction in the emitter voltage of transistor Q1. This reduction in emitter voltage tends to reduce the current flow of transistor Q1 and, with it, the current flow in control cathode 32. This reduction in current causes a reduction in the voltage $V_A$ appearing at the base of transistor Q5 and therefore tends to turn transistor Q5 off. As transistor Q5 begins turning off, the voltage $V_B$ at the base of transistor Q6 increases, thereby increasing the current flow through both transistor Q1 and control cathode 32. The steady state of the feedback loop including transistors Q1, Q5 and Q6 is attained when the current through resistor R5 is sufficient to generate a base voltage $V_A$ approximately equal to the base-emitter voltage of transistor Q5. In this manner, current control feedback section 18 regulates the voltage applied to anode 28 and thereby regulates the current flow through display cathodes 30. Once the anode voltage ANODE 0 has properly been adjusted, it remains at this level until transistor Q1 is turned off and current no longer flows through control cathode 32.

At time t3, shift register 36 returns its D0 output to the binary "1" level, causing transistor Q1 to turn off and thereby returning the anode 28 of tube 20 to the 90 volt level. See FIGS. 2C and 2G. Simultaneously, shift register 36 switches its D1 output to the binary "0" level, turning transistor Q2 on and applying a 180 volt biasing potential to the anode 28 of tube 22. See FIGS. 2C and 2J. After a short time delay (at time t4) tube 22 fires and feedback section 18 regulates the voltage on the anode 28 of tube 22 in the manner described above with reference to tube 20. As shown in FIGS. 2G and 2J, feedback circuit 18 regulates the anode voltage of tube 20 to 160 volts while it regulates the anode voltage of tube 22 to 150 volts. These voltage differences are the result of variations in the parameters of the tubes 20, 22. In both cases, however, a predetermined current is caused to flow through the control cathode 32 of each tube 20, 22, thereby regulating the luminosity of the grounded cathodes 30 of these tubes. This process is repeated for tubes 24 and 26 as illustrated in FIGS. 2K and 2L, respectively.

In some applications, it is necessary to provide a time period when none of the anodes 28 receive an enabling pulse from shift register 36. Such "dead time" is required when all of the tubes 20–26 are formed within a single glass enclosure or when the anode drive pulses are also used as drive pulses for scanning capacitive touch pad circuits. In such cases, a switching transistor Q7 is utilized to drive transistor Q5 into saturation, thereby decreasing the base voltage $V_B$ on transistor Q6 and turning off all of transistors Q1–Q4, during the "dead time". As shown in FIG. 1, the CLOCK pulses applied to the clock input of shift register 36 are also applied to the base of transistor Q7 via resistor R8. As a result, transistor Q7 will be turned on and a 5 volt biasing potential will be applied through R8 to the base of transistor Q5 during each negative going clock pulse. In this condition, transistor Q5 is saturated and the voltage $V_B$ on the base of transistor Q6 is reduced to a level which turns off all of the transistors Q1–Q4.

Since conventional gas discharge tubes do not include a special control cathode, it is often desirable to utilize display cathode segments which are not used in a particular application as the control cathode 32. In such cases, an opaque mask must be applied to the glass enclosure of each tube 20–26 over the area where the control cathode is located to prevent light from the control cathode from reaching the eye of the user. While this is a satisfactory solution in most cases, this solution exhibits one major drawback. Since current does not flow through the control cathodes 32 until after breakdown of the insulative gas in the tubes, regulation of the anode voltage does not begin until after application of the maximum tube firing pulse voltage (i.e., 180 volts). Where the high voltage supply (i.e., 180 volts) is not regulated, such as when the high voltage is derived directly from the line voltage without additional regulation, the supply can vary as much as ±12 percent from the nominal value. When the voltage of the line, and therefore the voltage of the supply, is at maximum value, the anode voltage goes to this value until current begins flowing through the control cathode and the anode voltage is regulated thereby. In some cases, this maximum value is sufficiently high to fire cathode elements which are supposed to be turned off. While this firing only lasts until regulation takes over, its net effect is to provide a slight glow or smearing effect on display tubes which should be dark.

Figure 3:
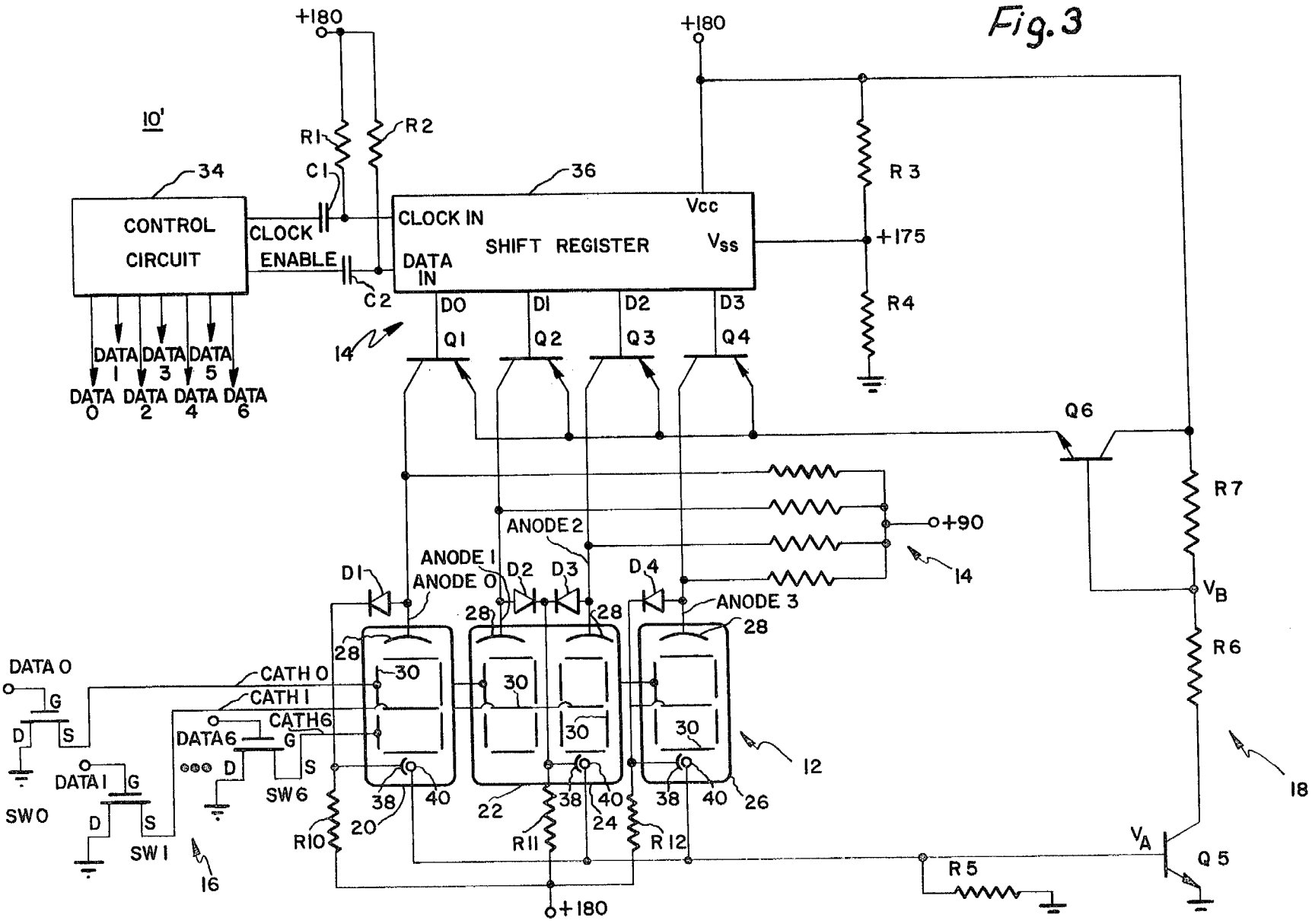
FIG. 3 is a second embodiment of a gas discharge display circuit constructed in accordance with the principles of the present invention wherein keep-alive cathodes are utilized as control cathodes.

One solution to this problem is illustrated in FIG. 3. The gas discharge display circuit of FIG. 3 is substantially identical to that of FIG. 1 with the following exceptions; tubes 22 and 24 are encased in a single housing, encased within each of the tube housings is a keep-alive anode 38 and a keep-alive cathode 40, and each of the anodes 28 of the tubes 20–26 are coupled to the 180 volt supply voltage via respective diodes D1, D2, D3 and D4 and respective high impedance resistors R10, R11 and R12.

Conventional gas discharge tubes are provided with keep-alive elements, comprising keep-alive cathodes 38 and keep-alive anodes 40, which are energized at all times and which provide a source of ions and ionization photons in order that rapid firing during each multiplex time period will occur. In order to ensure that regulation will take place as soon as any one of the anodes 28 receives a tube firing pulse ANODE 0, ANODE 1, ANODE 2, or ANODE 3 from tube selection section 14, each of the keep-alive cathodes 40 are coupled to resistor R5 and are utilized as the control cathodes of the present invention. In addition, each of the keep-alive anodes 38 are coupled to its associated anode 28 by respective diodes D1–D4 in order that current will flow in keep-alive cathode 40 as soon as a tube firing pulse is applied to its associated anode 28. The delay time (t2-t1 in FIG. 2) between the application of a tube firing pulse and the initiation of tube regulation which was inherent in the embodiment of FIG. 1 does not occur in the embodiment of FIG. 3 since a small amount of current is constantly flowing between keep-alive anode 38 and keep-alive cathode 40 even when a tube firing pulse is not applied to its associated anode 28.

In the embodiment of FIG. 1, current control feedback section 18 adjusted the voltage on the anode 18 of the turned-on tube 20–26 as a function of the current in the control cathode 32. In the present embodiment, the current control feedback section 18 controls the voltage on keep-alive anode 38 as a function of the current through keep-alive cathode 40. However, since each keep-alive anode 38 is coupled to its associated anode(s) 28 by a respective diode D1–D4, the voltage at the associated anode(s) 28 will follow the voltage at the keep-alive anode 38, the magnitude of the forward biased diode drop being negligible. As a result, the magnitude of the tube firing pulses ANODE 0–ANODE 3 applied to the anodes 28 will be riding at a value which yields the proper current (as detected by the current in keep-alive cathode 40) for the display cathodes 30 associated with the anode 28 receiving the tube firing pulse.

Figure 4:
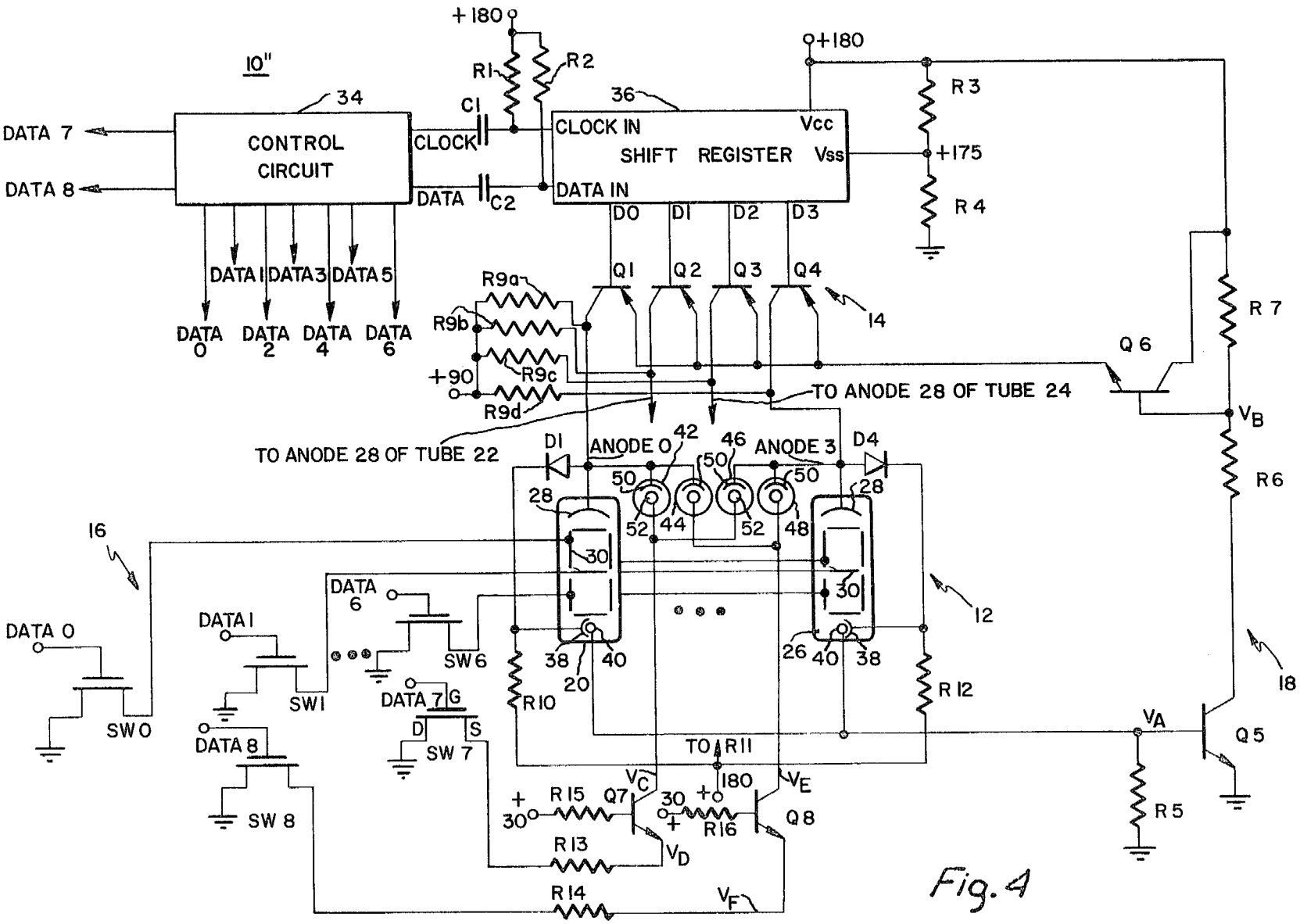
FIG. 4 is a circuit diagram of a third embodiment of the present invention wherein the drive circuitry for the gas discharge tubes is also used as drive circuitry for neon indicator lights.

In many electronic control systems which utilize gas discharge displays, it is often necessary to light a few neon bulbs which are used as indicator lights. While the indicator function could be provided by additional gas discharge tubes, this is not a cost effective solution since the cost of neon lights is substantially less than that of gas discharge tubes. A circuit which incorporates a plurality of neon lights 42, 44, 46 and 48 into the gas discharge display circuit of the present invention is illustrated in FIG. 4. This circuit utilizes the driver circuitry of the present invention to selectively enable the neon lights 42–48 as well as the gas discharge tubes 20–26.

The embodiment of FIG. 4 is identical to that of FIG. 3 with the exception that the neon lights 42–48, transistors Q7 and Q8 and switches SW7 and SW8 have been added. Tubes 22 and 24 have been omitted from this drawing for purposes of simplicity. While the use of the neon lights 42–48 has been illustrated in connection with the embodiment of FIG. 3, it could also be used in connection with the embodiment of FIG. 1, as well as with other modifications of the invention which would be apparent to those skilled in the art.

Each neon light 42–48 includes an anode 50 and a cathode 52. In order to form an X-Y matrix which makes it possible to fire any desired one of the neon lights 42–48, the anodes 50 of neon lights 42 and 44 are coupled to the anode 28 of tube 20 and receive the tube firing pulse ANODE 0. The anodes 50 of neon lights 46 and 48 are both coupled to the anode 28 of tube 26 and receive tube firing pulse ANODE 3. Accordingly, a firing potential of 180 volts will be applied to the anodes 50 of neon lights 42 and 44 whenever shift register 36 turns on transistor Q1 and a firing pulse of 180 volts will be applied to the anodes 50 of lights 46 and 48 whenever shift register 36 turns on transistor Q4.

The cathodes 52 of neon lights 42, 46 are coupled to the source terminal S of a low-breakdown-voltage saturated switch SW7 via current limiting transistor Q7 and resistor R13. The cathodes 52 of neon lights 44 and 48 are coupled to the source terminal S of a low-breakdown-voltage saturated switch SW8 via current limiting transistor Q8 and resistor R14. Switches SW7 and SW8 are identical to the switches SW0–SW6 of display cathode selection section 16 and may be formed integrally therewith in accordance with standard integrated circuit processes. The gates of switches SW7, SW8 are coupled to the data outputs DATA 7, DATA 8, respectively, of control circuit 34. These outputs determine which of the neon lights 42–48 are to be lighted at any given instant. Whenever control circuit 34 generates a binary "1" on either of its data outputs DATA 7, DATA 8, the associated switch SW7, SW8, respectively, will be turned on, grounding the emitter of its associated transistor Q7, Q8, respectively. That neon light 42–48 whose anode 50 receives a tube firing pulse and whose cathode is connected to the grounded switch SW7 or SW8 will fire, causing current to flow through its associated current limiting switch Q7, Q8. The switches Q7, Q8 will thereafter limit the current through the lighted neon lights 42–48 so as to sustain the desired brightness in the light.

Figure 5:
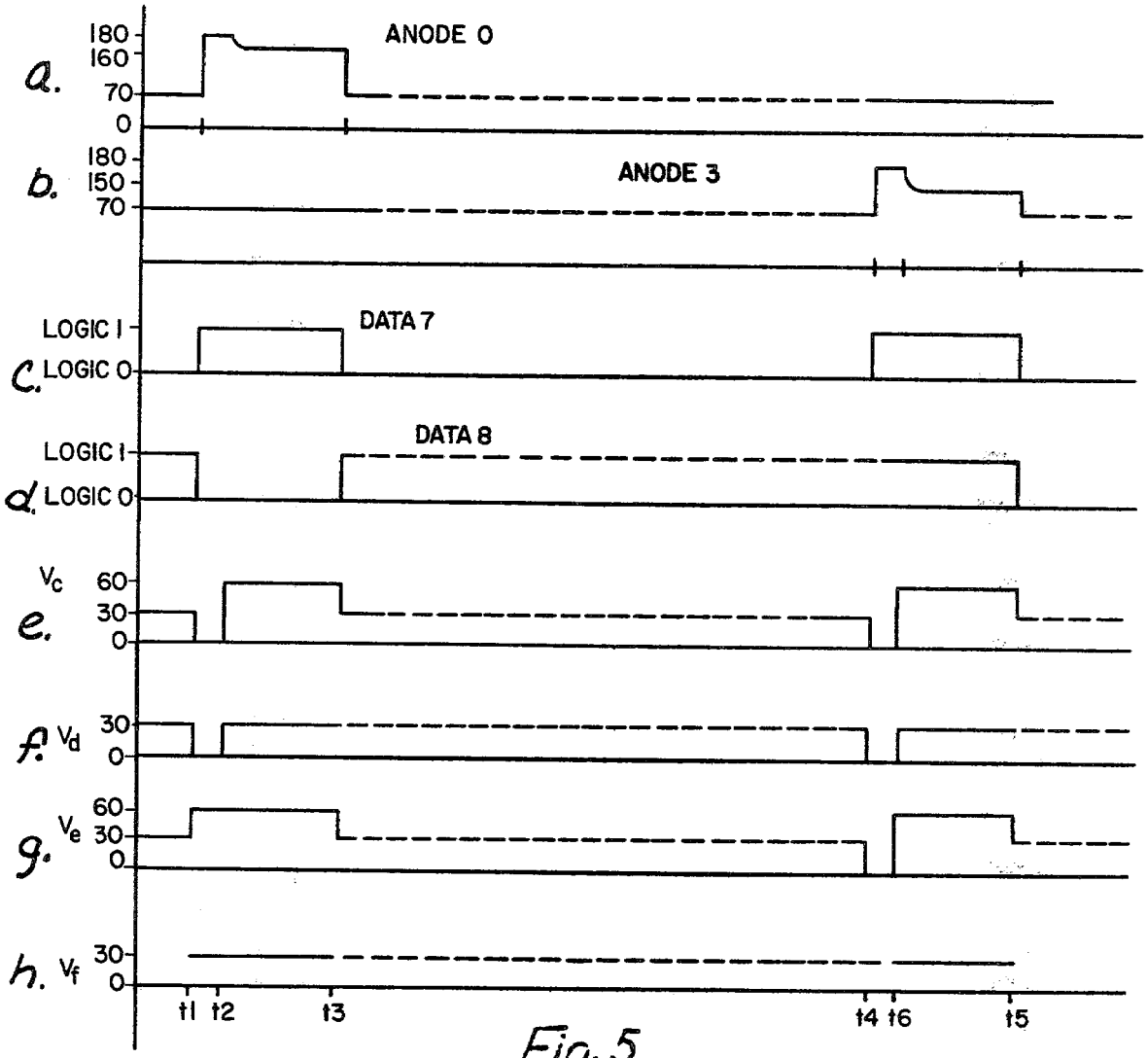
FIG. 5 is a timing diagram for the circuit of FIG. 4.

The manner in which neon lights 42–48 are enabled may best be understood with reference to the timing diagram of FIG. 5. As shown in FIGS. 5A and 5B, the tube firing pulse ANODE 0 is applied to the anode 28 of tube 20 during the time interval t1-t3. This signal is simultaneously applied to the cathodes 50 of neon lights 42, 44. During this interval, control circuit 34 generates a binary "1" on its DATA 7 output and a binary "0" on its DATA 8 output. See FIGS. 5C and 5D. The binary "1" on the DATA 7 output of control circuit 34 turns switch SW7 on, thereby grounding its source terminal S. In this condition, the base-emitter junction of transistor Q7 is forward biased, causing current to flow from the 30 volt biasing potential applied to resistor R15 through the base-emitter junction, resistor R13 to ground. Since the magnitude of resistor R15 is selected to be much larger than that of resistor R13, the voltage $V_D$ at the emitter of transistor Q7 is at approximately 0 volts. See FIG. 5F. Since the base-emitter junction of transistor Q7 is forward biased, the voltage $V_C$ at the collector of transistor Q7 will also be at 0 volts. As such, neon light 42 will be enabled by the tube firing pulse ANODE 0 applied to its anode 50 and will fire after a time delay t2-t1. At this point, the current into the cathode 52 of neon light 42 will be permitted to flow through resistor R13 via transistor Q7. This current will continue to increase until the voltage Vd at the emitter of transistor Q7 rises to slightly less than 30 volts. At this point, transistor Q7 begins to cut off and transistor Q7 begins to limit current. Transistor Q7 will stabilize when just enough current passes through resistor R13 to maintain the voltage $V_D$ at just less than 30 volts. In the example illustrated, this condition occurs when the voltage $V_C$ on the cathode 52 of neon light 42, and therefore at the collector of transistor Q7, is at about 60 volts. Voltages $V_C$ and $V_D$ will remain in this condition until the tube drive pulse ANODE 0 is removed from the cathode 50 of neon light 42. Compare FIGS. 5A, 5E and 5F. As a result of the foregoing, the current through neon light 42 will be stabilized at the predetermined desired value.

During the time period in which transistor Q7 is conducting, the DATA 8 output of control circuit 34 is at a binary "0" level (See FIG. 5D) and switch SW8 is turned off. With switch SW8 off, the voltage $V_F$ appearing at the emitter of transistor Q8 will be approximately 30 volts and transistor Q8 will be turned off. In this condition, the voltage $V_E$ at the collector of transistor Q8 will be free to float to a sufficiently high value (60 volts in the example shown) to prevent neon light 44 from firing. As a result, tube 42 will light while neon light 44 will not.

A similar analysis may be made with respect to neon lights 46, 48. As shown in FIG. 5B, the tube firing pulse ANODE 3 is applied to the anode 28 of tube 26 during the time interval t4-t5. Simultaneously, this pulse is applied to the anodes 50 of neon lights 46, 48. As shown in FIGS. 5C and D, both data outputs DATA 7 and DATA 8 of control circuit 34 are at the binary "1" level. As a result, switches SW7 and SW8 will both be on and the emitters of transistor Q7 and Q8 will both be grounded. See FIGS. 5E and 5F. In this condition, the base-emitter junction of both transistors will be forward biased. Since the magnitude of resistors R15 and R16 is chosen to be substantially larger than the magnitude of resistors R13 and R14, respectively, the voltages $V_D$ and $V_F$ at the emitters of transistors Q7 and Q8, respectively, will be at approximately 0 volts. Since the base-emitter junctions of transistors Q7, Q8 are forward biased, their collector voltages $V_C$, $V_E$, respectively, will also be at 0 volts, permitting neon tubes 46, 48 to both fire at time t5. As soon as current begins flowing into the anodes 52 of neon lights 46, 48, the voltages $V_C$ and $V_E$ at the collector of transistors Q7 and Q8, respectively, will increase until sufficient current flows through the transistors to cause the emitter voltages $V_D$ and $V_F$ of transistors Q7 and Q8, respectively, to rise to slightly less than 30 volts. Transistors Q7 and Q8 will then regulate the current flow to ensure that the voltages $V_D$, $V_F$ and $V_C$, V are at approximately 30 and 60 volts, respectively. See FIGS. 5E–5H.

The present invention may be embodied in other specific forms without departing from the spirit or essential attributes thereof and, accordingly, reference should be made to the appended claims, rather than to the foregoing specification, as indicating the scope of the invention.

What is claimed is:

1. A gas discharge display, comprising:

a gas discharge tube including an anode, a plurality of display cathodes and a control cathode;

means for applying a voltage of sufficient magnitude to said anode to cause said tube to fire to cause a control current to flow through said control cathode, said control current being representative of the magnitude of the current flowing through lighted ones of said display cathodes;

means for determining which ones of said display cathodes are to be lighted when said gas discharge tube is fired; and current regulation means responsive to the current flow through said control cathode for adjusting the magnitude of the voltage applied to said anode to a level causing said control current to reach a predetermined value at which the current through, and therefore the luminosity of, said lighted display cathodes is also adjusted to a predetermined level.

2. The gas discharge display of claim 1, wherein said current regulation means includes an impedance element receiving said control current; and means for adjusting said anode voltage to a level which causes said control current to induce a predetermined voltage across said impedance element.

3. The gas discharge display of claim 2, wherein said adjusting means comprises a transistor operating in an amplification mode and having an input terminal and an output terminal, said input terminal receiving said voltage across said impedance element and said output terminal controlling the operation of additional circuitry which adjusts said anode voltage to said level which causes said control current to induce said predetermined current across said impedance element.

4. The gas discharge display of claim 1, wherein said means for determining which ones of said display cathodes are lighted comprises a plurality of saturated switches and a control circuit for turning selected ones of said saturated switches on, each of said saturated switches being coupled to a respective one of said display cathodes.

5. The gas discharge display of claim 4, wherein current only flows through those ones of said display elements which are grounded when said voltage of a significant magnitude is applied to said anode such that only said grounded display cathodes are lighted.

6. The gas discharge display of claim 5, wherein each of said saturated switches grounds the display cathode to which it is coupled whenever it is turned on by said control circuit.

7. The gas discharge display of claim 6, wherein said control circuit generates a plurality of data outputs, each data output being coupled to said control input of a respective one of said saturated switch to cause the state of each said switch to be determined by the voltage at said control circuit data output to which said switch is connected.

8. The gas discharge display of claim 6, wherein the display cathodes connected to those saturated switches which are off are permitted to float to a voltage level which prevents current flow therethrough.

9. The gas discharge display of claim 8, wherein each of said saturated switches is a MOSFET.

10. The gas discharge display of claim 1, wherein said control cathode is identical to said display cathodes and wherein a portion of a glass casing forming part of said gas discharge tube is covered with an opaque material in the area of said control cathode such that said control cathode is not normally visible to an individual viewing said gas discharge display.

11. The gas discharge display of claim 1, wherein said gas discharge tube includes a keep-alive anode and a keep-alive cathode, said keep-alive cathode defining said control cathode, said keep-alive anode being coupled to said anode in such a manner that the magnitude of the voltage on said keep-alive anode follows that on said anode as said voltage on said anode is adjusted by said current regulation means.

12. The gas discharge display of claim 11, wherein said keep-alive anode is coupled to said anode by a diode.

13. The gas discharge display of claim 1, further including a neon indicator light including an anode and a cathode, said anode being coupled to the anode of said gas discharge tube and receiving said voltage of sufficient magnitude, said cathode being coupled to a saturated switch which is selectively enabled whenever said neon indicator light is to be fired.

14. The gas discharge display of claim 13, further including current limiting means for limiting the current flow through said neon light after said neon light has been fired.

15. A method for firing a gas discharge tube of the type including an anode, a plurality of display cathodes and a control cathode, comprising the steps of:

applying a tube firing pulse of a sufficient magnitude to said anode to cause said gas discharge tube to fire;

adjusting the voltage level on said display cathodes to cause current to flow from said anode through selected ones of said display cathodes and said control cathode when said gas discharge tube is fired and those display cathodes having current flowing therethrough light; and adjusting the magnitude of the tube firing pulse applied to said anode as a function of said current through said control cathode to cause said current through said control cathode to reach a predetermined level.

16. The method of claim 15, wherein said step of adjusting the voltage level on said display cathodes comprising the step of grounding said selected ones of said display cathodes.

17. A gas discharge display circuit, comprising:

a plurality of gas discharge tubes, each of said gas discharge tubes comprising an anode, a plurality of display cathodes and a control cathode, said control cathode receiving a control current representative of the magnitude of the current flowing through lighted ones of said display cathodes whenever the gas discharge tube of which it forms a part is fired;

display tube selection means for sequentially applying a tube firing pulse to said anodes of each of said gas discharge tubes in a time multiplexed manner to cause each of said tubes to be sequentially fired;

display cathode selection means for determining which display cathodes of the fired gas discharge tube will be lighted; and current control regulation means responsive to the current flowing through the control cathode of the fired gas discharge tube for adjusting the magnitude of said tube firing pulse to cause the current through said control cathode to reach a predetermined value.

18. The gas discharge display circuit of claim 17, wherein said current control regulation means includes an impedance element coupled to said control cathodes and receiving said control current; and means for adjusting the magnitude of said tube firing pulse to a level to cause said control current to induce a predetermined voltage across said impedance element.

19. The gas discharge display circuit of claim 18, wherein said adjusting means comprises a transistor operating in an amplification mode and having an input terminal and an output terminal, said input terminal receiving said voltage across said impedance element and said output terminal controlling the operation of additional circuitry which adjusts the magnitude of said firing pulse to a level which causes said control current to induce said predetermined current across said impedance element.

20. The gas discharge display circuit of claim 17, wherein said means for determining which ones of said display cathodes are lighted comprises:

a plurality of saturated switches, each of said saturated switches being coupled in parallel to a respective one of said display cathodes in each of said gas discharge tubes; and control circuit means for turning selected ones of said saturated switches on, the particular ones of said saturated switches which are turned on by said control circuit being redetermined each time a tube firing pulse is applied to said anode of a different one of said gas discharge tubes whereby the display pattern displayed by each of said discharge tubes is determined by said control circuit.

21. The gas discharge display circuit of claim 20, wherein current only flows through those ones of said display elements which are grounded and which form part of said gas discharge tube whose anode receives said tube firing pulse.

22. The gas discharge display circuit of claim 21, wherein each of said saturated switches grounds the display cathodes to which it is coupled whenever it is turned on by said control circuit.

23. The gas discharge display circuit of claim 20, wherein said control circuit generates a plurality of data outputs, each data output being coupled to said control input of a respective one of said saturated switches to cause the state of each said saturated switch to be determined by the voltage at said control circuit data output to which said switch is connected.

24. The gas discharge display circuit of claim 23, wherein the display cathodes connected to those saturated switches which are off are permitted to float to a voltage level which prevents current flow through said display cathode connected to those saturated switches which are off.

25. The gas discharge display circuit of claim 17, wherein each of said control cathodes are identical to said display cathodes and further including means forming an opaque covering over said control cathodes such that said control cathodes are not normally visible to an individual viewing said gas discharge tubes.

26. The gas discharge display circuit of claim 17, wherein each of said gas discharge tubes has a keep-alive anode and a keep-alive cathode associated therewith, said keep-alive cathode defining said control cathode for each of said gas discharge tubes with which it is associated, said keep-alive anode being coupled to said anode of each of said gas discharge tubes with which it is associated in such a manner that the magnitude of the voltage on said keep-alive anode follows that on said anode of said tube with which it is associated as said voltage on said anode of said tube with which it is associated is adjusted by said current control regulation means.

27. The gas discharge display circuit of claim 26, wherein each of said keep-alive anodes are coupled to said anodes of said tubes with which they are associated by a respective diode.

28. The gas discharge display circuit of claim 17, further including:

a plurality of neon indicator lights, each of said neon indicator lights including an anode and a cathode; and X-Y matrix means for selectively firing each of said neon indicator lights, the X inputs to said X-Y matrix including at least first and second ones of said tube firing pulses, the Y inputs to said X-Y matrix coming from at least first and second saturated switches.

29. The gas discharge display circuit of claim 28, wherein said first saturated switch is coupled to the anodes of at least first and second ones of said neon indicator lights and wherein said second saturated switch is coupled to the anodes of at least third and fourth ones of said neon indicator lights.

30. The gas discharge display circuit of claim 29, further including first and second current limiting means for limiting the current through said anodes of said first and second neon indicator lights and said anodes of said third and fourth neon indicator lights, respectively.

31. The gas discharge display circuit of claim 30, wherein said current limiting means each comprises a transistor which is biased to operate in the amplification mode when a neon indicator light with which it is associated is fired.

* * * * *